US006131803A

United States Patent [19]

Oliff et al.

[11] Patent Number: 6,131,803

[45] Date of Patent: Oct. 17, 2000

[54] CARTON WITH REINFORCED HANDLE STRUCTURE

[75] Inventors: James R. Oliff, Douglasville; Aaron Bates, Marietta; John M. Holley, Jr., Lawrenceville, all of Ga.

[73] Assignee: The Mead Corporation, Dayton, Ohio

[21] Appl. No.: 09/382,428

[22] Filed: Aug. 24, 1999

Related U.S. Application Data

[63] Continuation-in-part of application No. 09/336,502, Jun. 18, 1999.

[51] Int. Cl.[7] ..... B65D 5/468

[52] U.S. Cl. ..... 229/117.13; 229/117.12

[58] Field of Search ..... 229/117.12, 117.13; 206/141, 427

[56] References Cited

U.S. PATENT DOCUMENTS

| | | | |
|---|---|---|---|
| 2,482,399 | 9/1949 | Bullock | 229/117.13 |
| 2,896,838 | 7/1959 | Struble | 229/117.12 |
| 3,094,268 | 6/1963 | Swanson et al. | 229/117.13 |
| 3,300,119 | 1/1967 | Chaussades | 206/434 |
| 3,933,303 | 1/1976 | Kirby, Jr. | 229/117.13 |
| 5,333,734 | 8/1994 | Stout et al. | 206/427 |
| 5,385,234 | 1/1995 | Stout et al. | 206/427 |
| 5,480,091 | 1/1996 | Stout | 229/117.14 |
| 5,593,027 | 1/1997 | Sutherland | 206/170 |
| 5,826,782 | 10/1998 | Stout | 229/117.13 |
| 5,873,515 | 2/1999 | Dunn et al. | 229/117.13 |

FOREIGN PATENT DOCUMENTS 2 252 958 8/1992 United Kingdom .

*Primary Examiner*—Gary E. Elkins
*Attorney, Agent, or Firm*—Michael V. Drew

[57] ABSTRACT

A handle structure for a carton 12 is formed within a panel 20, 28 having a strap member 14, 44, 46 extending between end edges of the panel. An elongated web 54 extends diagonally from an intersection of side and end edges of the panel. The elongated web 54 includes a perforated line 57 and a score line 56 intermediate the perforated line and the end edge of the panel. A connecting tab 70 lies intermediate the end region of the strap member and foldably interconnects the strap member with a region of the panel that lies between the strap member and one of the side edges of the panel. The perforated line and score line of the elongated web intersect at a point distal the vertex of side and end edges.

9 Claims, 5 Drawing Sheets

CARTON WITH REINFORCED HANDLE STRUCTURE

RELATED APPLICATIONS

This application is a continuation-in-part of application number 09/336,502 filed Jun. 18, 1999, currently pending.

TECHNICAL FIELD OF THE INVENTION

The invention relates to cartons, and more particularly, to cartons having a reinforced handle structure that enhances carton integrity and appearance.

BACKGROUND OF THE INVENTION

Handles are useful in cartons as a means for transporting the cartons. It is often desirable to have a carton that presents walls that are as aesthetically appealing as possible to potential purchasers of the package formed by the carton. Thus, it can be appreciated that it would be desirable to have a carton with a handle structure that functions within a carton wall or panel that is also aesthetically appealing.

SUMMARY OF THE INVENTION

According to a preferred embodiment of the invention, a handle structure for a carton is formed within a panel having a strap member extending between end edges of the panel. An elongated web extends diagonally from an intersection of side and end edges of the panel. The elongated web includes a perforated line and a score line intermediate the perforated line and the end edge of the panel.

In another aspect of the preferred embodiment, a connecting tab lies intermediate the end region of the strap member and foldably interconnects the strap member with a region of the panel that lies between the strap member and one of the side edges of the panel.

In another aspect of the preferred embodiment, the perforated line and score line of a web intersect at a point distal the end edge of the panel.

In still another aspect of the preferred embodiment, the strap member is defined by opposing edges and a portion of at least one of the opposing edges of the strap member is coincident with the score line.

In a further aspect of the preferred embodiment of the invention, the strap member tapers inwardly, and a connecting tab interconnects the strap member with a region of the panel intermediate the strap member and one of the side edges.

In a still further aspect of the preferred embodiment, a portion of an edge of the strap member is coincident with the score line and terminates at the connecting tab described immediately above.

In still an additional aspect of the preferred embodiment, an arcuate fold line traverses the end region of the strap member and is substantially coincident with the perforated lines of the elongated webs.

Other advantages and objects of the present invention will be apparent from the following description, the accompanying drawings, and the appended claims.

DETAILED DESCRIPTION OF THE PREFERRED EMBODIMENTS

Figure 1:
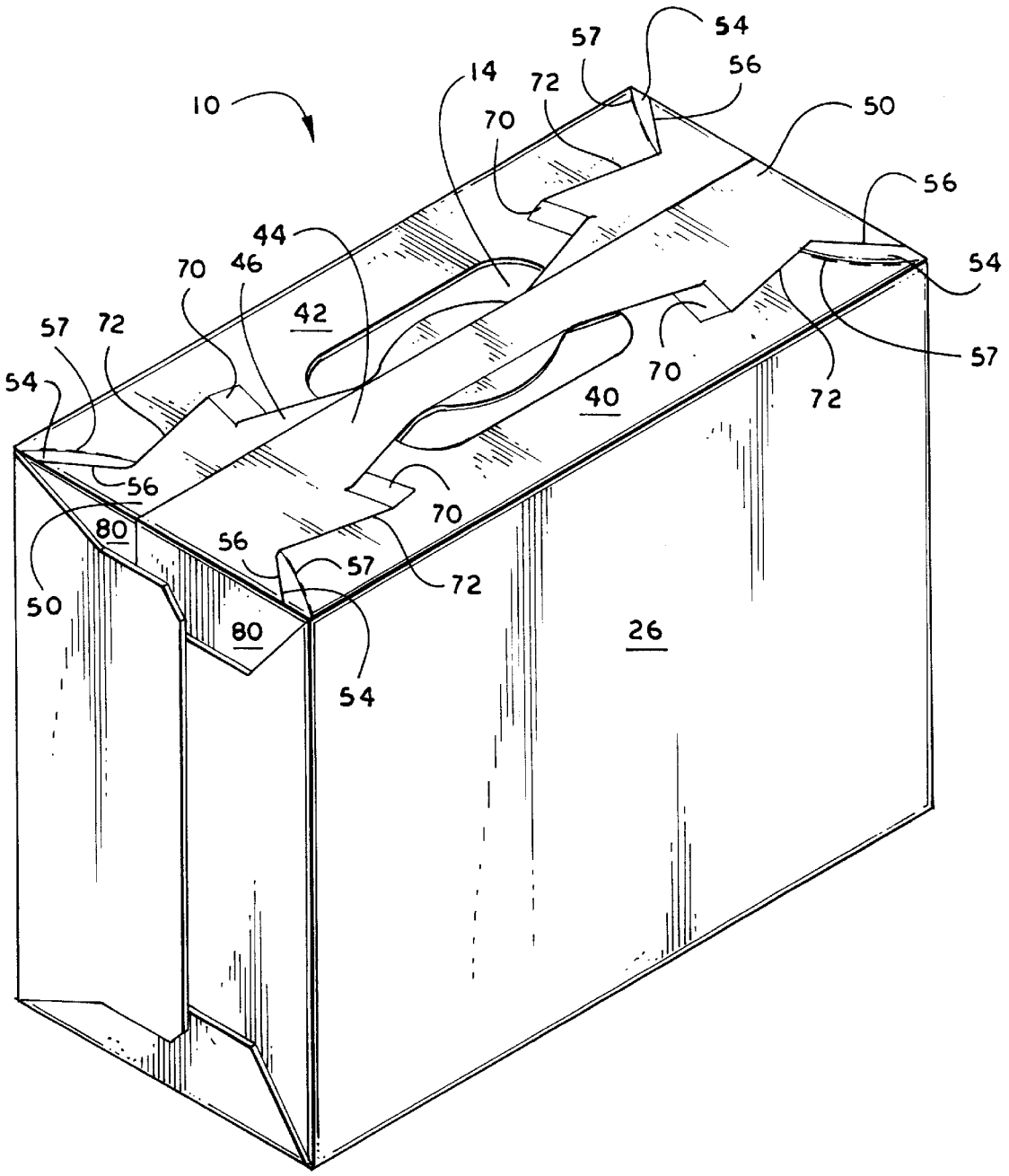
FIG. 1 is an isometric illustration of a carton having a handle structure in accordance with a preferred embodiment of the invention.

Throughout the drawings, the same reference numerals are used to denote the same or like features of the invention.

Figure 2:
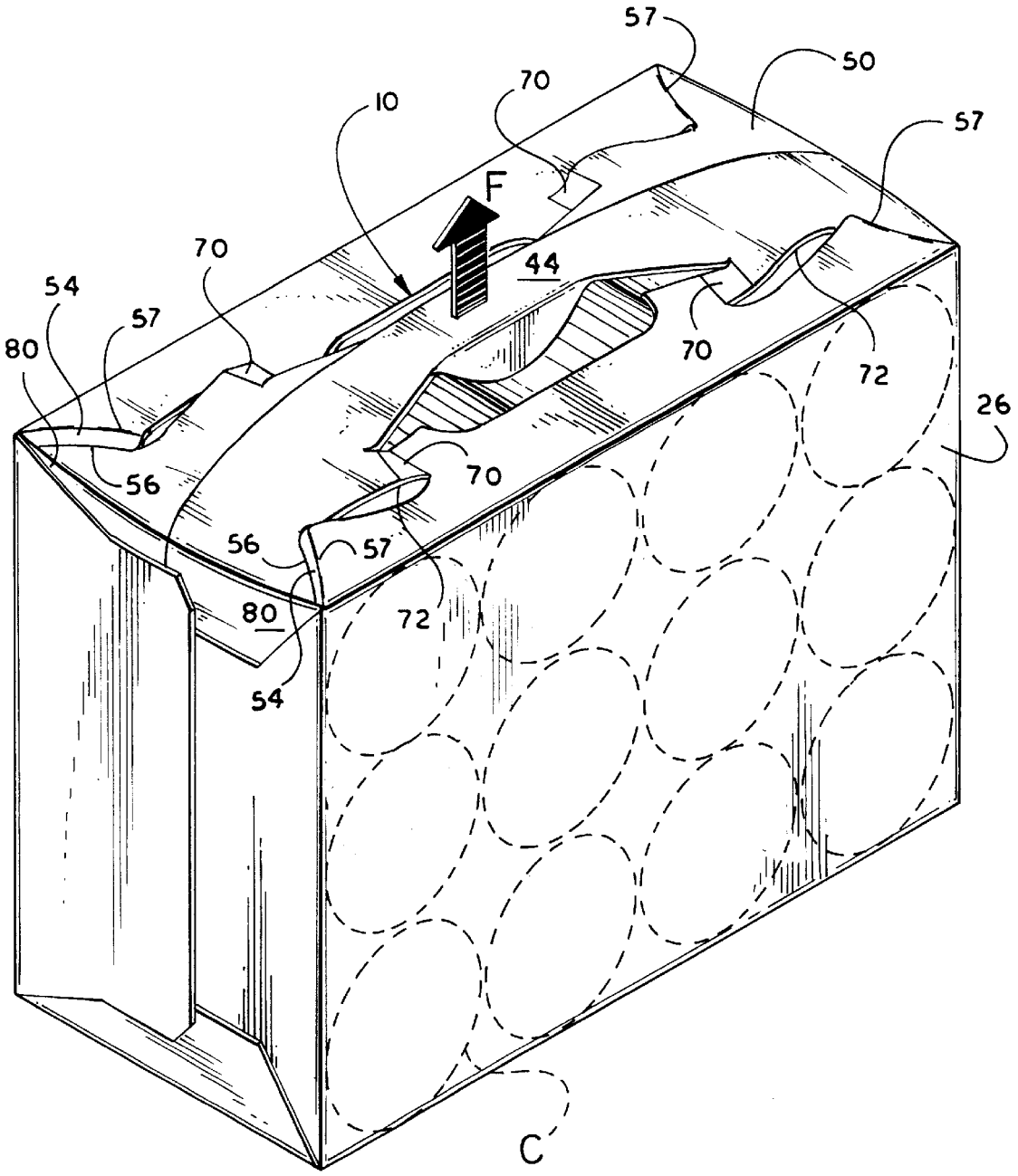
FIG. 2 is an isometric illustration of the carton of FIG. 1 with the handle member lifted upwardly.
Figure 3:
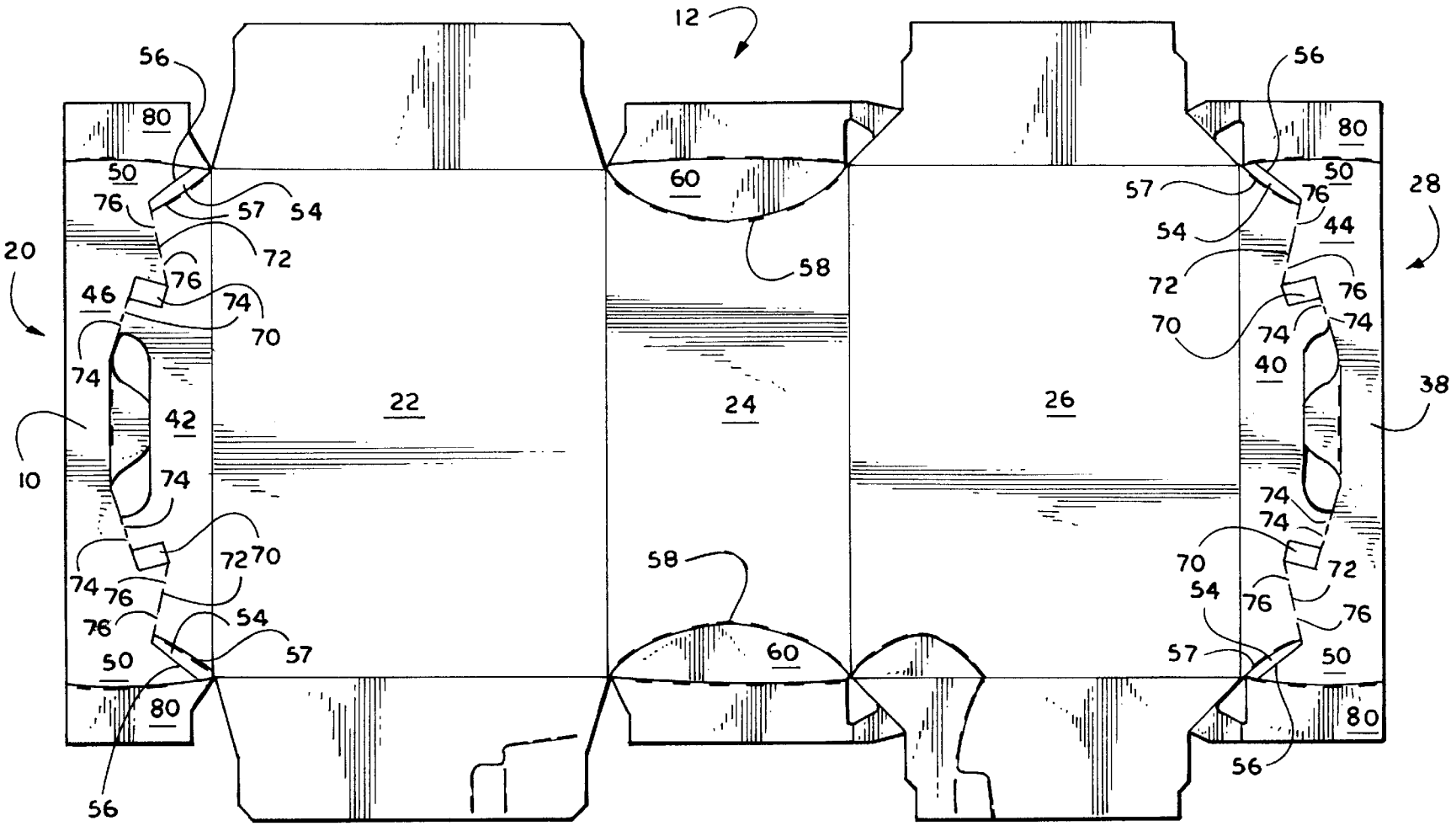
FIG. 3 is a plan view of a blank for forming the carton with the handle structure shown in FIG. 1.

For convenience of understanding, reference may be made to FIGS. 1, 2 and 3 simultaneously. FIGS. 1 and 2 illustrate a carton 10 having a handle structure in accordance with a preferred embodiment of the invention. FIG. 3 illustrates the blank 12 from which the carton of FIGS. 1 and 2 is formed.

FIG. 2 illustrates the transverse alignment of cans C with respect to the carton's 10 handle structure in accordance with a preferred embodiment of the invention. FIG. 2 also depicts the manner in which the top wall of the carton 10 including its handle structure bows upwardly when a force F is applied to lift the strap member 14.

The environment of the handle structure of the invention is a carton 10 that forms an enclosure from a series of interconnected panels. In FIG. 3, the main adjoining panels 20, 22, 24, 26 and 28 which form a tubular structure when the end-most panels 20, 28 are joined are most clearly seen.

The end-most panels 20, 28 of the blank 12 form the top wall, or panel, of the carton 12 that contains the handle structure. For convenience of explanation, each portion of the top panel 20, 28 is further described in segments. Each half-panel has a strap member 46, 44 with a tapered region 30, 38 mediate the end regions. The remaining portion 40, 42 of the top panel lies along a side edge of the top panel. Flaps 80 adjoin the end edges of the top panel. Each flap forms at least a portion of an end wall in the erected carton.

In the erected carton 10, the strap members 46, 44 overlap, to a certain extent, and the tapered regions 30, 38 overlap fully to produce a substantially reinforced handle. At the end regions of the strap handle members 46, 44 a web extends diagonally from the vertex of a side edge and an end edge of the panel.

The elongated webs 54 are defined by a spaced-apart pairing of a perforated line 57 extending diagonally from the aforementioned vertex and a score line 56 lying between the perforated line and the end edge of the panel 20, 28. The intersection of the score line 56 and perforated line 57 enhances the effectiveness of the invention.

A connecting member 70 conjoins the strap member 46, 44 and a portion of the region 42, 40 of the top panel adjacent the strap member 46, 44. Stress upon the end region of the handle structure is more evenly directed toward the ends of the handle structure and carton through the coincidence of an edge 72 (appearing as a cut line in the blank 12) of the strap member 46, 44 with the score line 56 of the elongated web. Further enhancement of the operation of the handle structure is achieved by termination of the edge 72 at the connecting tab 70.

Optionally, the end regions of the top panel, which coincide with the end regions of the handle structure, may have an intermediate web panel 50 defined by a curved, or arcuate, score line 58, which, in the blank 12, coincides with the perforated lines 57 of the elongated webs of the handle structure. Another pair of intermediate web panels 60 may also be formed at the opposing side of the carton.

The strap member 44, 46 provides a handle that directs stress toward the ends of the carton. The features of the handle structure which are described above cause the strap member 30, 38 and other elements upon the top panel of the carton to flex, or bow, in an outwardly-projecting predetermined manner when the carton 10 is lifted F. The structure of the elongated webs 54 cause the top panel 20, 28 to concavely bow in a stepped configuration, ascending inwardly, when the carton is lifted by a force, as illustrated in FIG. 2. The tapered strap member 30, 38 provides a convenient, reliable handle. The connecting tabs 70 interconnect the strap member 46, 44 and adjacent top panel regions 42, 40. This interconnection causes the top panel 20, 28 to maintain a more contiguous configuration when the carton is lifted. The side regions 42, 40 of the top panel have a tendency to flex away from the strap member. The connecting tabs inhibit such movement and promote a more pleasing appearance and greater integrity of the top panel of the carton.

The intermediate web panels 50, 60 enable the corners of the carton 10 to be drawn tighter when cans C or similar articles are transversely aligned in the carton with respect to the lengthwise dimension of the carton and top panel, as shown in FIG. 2.

The structure of the invention provides a handle that is reinforced and that directs stress away from the handle itself to the ends of the carton while helping the carton to maintain an aesthetically pleasing appearance and greater integrity when lifted.

Figure 4:
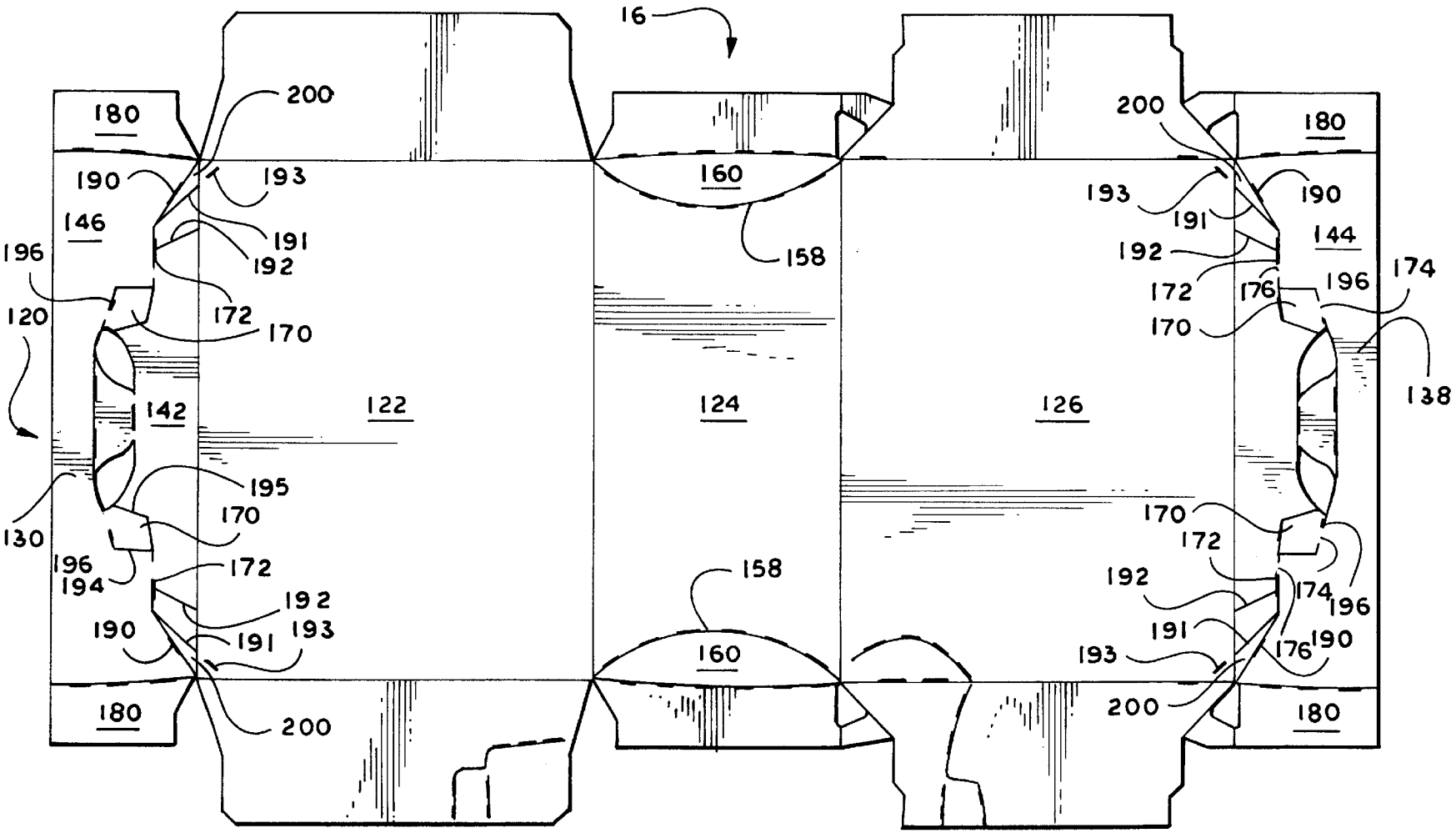
FIG. 4 is a view of a blank for forming a carton having a handle structure in accordance with an alternate preferred embodiment of the invention.
Figure 5:
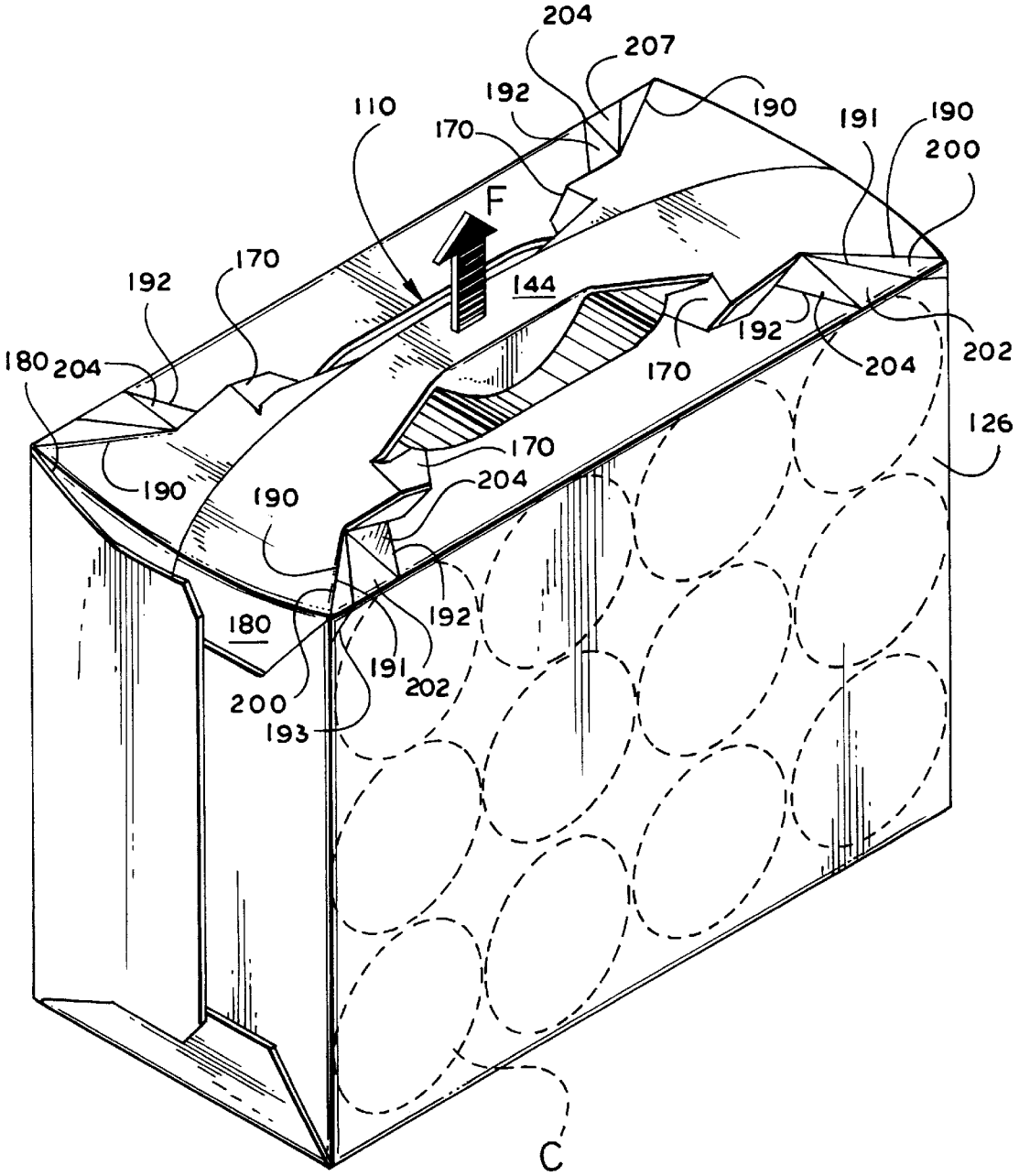
FIG. 5 is an isometric illustration of a carton having a handle structure in accordance with an alternate preferred embodiment of the invention formed from the blank of FIG. 4.

Referring now simultaneously to FIG. 4 and FIG. 5, therein is shown a carton having an alternate preferred embodiment of handle structure in accordance with the teachings of the invention. In FIGS. 4 and 5, features corresponding to like features of the preferred embodiment of the invention discussed above and illustrated in FIGS. 1–3 are denoted by the same reference numerals but in a "100" series. For example, panel 24 in the first embodiment is denoted as 124 in the alternate preferred embodiment.

In the alternate embodiment of FIGS. 4 and 5, a first corner web 200 is formed in each corner of the top wall in which the handle structure is formed by a perforated line 191 ("perforated" in that it consists of alternating cut segments and scored segments) and a first corner score line 191 convergingly extending from the comer of the top wall or panel toward the end edge of the strap member 144. The various "webs" in this alternate embodiment are also for convenience of explanation sometimes hereinafter alternately referred to as "gussets" and "pleats." The perforated line 190 intersects the proximate vertex of the top wall where a side edge and an end edge of the top wall intersect. The first corner score line 191 is disposed intermediate the perforated line 190 and the side edge of the top wall. A second comer score line 192 is disposed adjacent the first comer score line forming another web or gusset. A diagonal cut line 193 is disposed at each comer of the side wall 122, 126 adjacent the top wall in coincident alignment with the first comer score line 191.

The cut line 172 that defines each edge of the ends of the strap member may have many orientations but in the preferred alternate embodiment illustrated is optimally disposed in substantially parallel longitudinal alignment with the strap member and the side edges of the top wall.

Tabs 170 that serve as handle gussets (webs/pleats) are formed by tab score lines 194, 195. Although the tab score lines may have many different alignments with respect to one another, in the preferred alternate embodiment illustrated they are nonparallel. One of the tab score lines 195 is directed toward the handhole aperture. Each tab 170 is further defined by the cut lines 172 and 196 that define the edges of the strap member.

Referring now particularly to FIG. 5, the particular arrangement of elements of the handle structure of the alternate preferred embodiment described above and illustrated in FIG. 5 causes the top wall of the carton to deform in a controlled manner and direct stress in a predetermined manner. Referring momentarily particularly to FIG. 4, each cut line 172, 196 that separates the strap member structure from the remainder of the top wall and tabs 170, respectively, is interrupted by a nick member that provides joinder between these elements. As the strap member is lifted F, the nick members cause the strap member 144 and tabs 170 to become separated from one another and from the top wall in a predetermined manner such that the strap member is bowed outwardly and gussets 200, 202 and 204 become angularly displaced with respect to one another. Optimally, the first gusset 200 is displaced into condition inwardly of the outwardly-bowed strap member. The lifting force exerted upon the carton causes deformation which produces joinder between the diagonal cut lines and the first score lines. This deformation in turn causes the first gusset 200 to extend over the edge of the side wall of the carton. The arrangement of elements described directs stress to the corners of the carton. Further, when articles such as cans C are aligned in the carton, the enclosed cans at the corners of the carton adjacent the first gussets acts as a "beam" or bracing element.

In one optimum mode, as the strap member is lifted, the set nicks of connecting the strap member 144 and the tabs 170 before the set of nicks connecting the strap member proximate the tabs 170 and the remainder of the top wall.

Modifications may be made in the foregoing without departing from the scope and spirit of the claimed invention.

What is claimed is:

1. A carton having a strap type handle which bridges a handle aperture disposed in a carton handle panel which is hinged to two further carton panels along each of two opposed edges, wherein respective ones of the two further panels abut the tops and bases of cans, when present in the carton, wherein the strap handle extends longitudinally of the handle panel between two opposed end panels of the carton, and wherein a foldable gusset is provided between each comer of the carton and an adjacent end of the strap handle, each gusset being constructed and arranged to deform when the handle strap is raised under load out of the plane of the handle panel such that endmost cans disposed adjacent said opposed end panels and the handle panel act as bracing elements between said two further panels and allow significant lifting stresses to be dissipated in the two further panels around the tops and bases of said endmost cans, and wherein a web structure including a tab interconnecting said strap-type handle and said carton handle panel proximate said handle aperture provided in the handle panel between the each of the ends of the strap handle and each of said comer gussets to influence displacement of the strap handle out of the plane of the handle panel and/or the extent to which load is applied to the ends of those cans acting as bracing elements.

2. The carton of claim 1, wherein each of said comer gussets includes a perforated line and a score line in non-coincident relationship with one another.

3. The carton of claim 2, wherein said perforated line extends substantially toward a respective said corner of the carton.

4. The carton of claim 3, wherein said score line lies between said perforated line and a proximate one of said two opposed edges.

5. The carton of claim 4, wherein said perforated line and said score line diverge from a point mediate one of said comers and a respective said tab.

6. The carton of claim 5, further including a weakened line of demarcation in one of said two further carton panels in substantial coincident alignment with a point of intersection of an extension of said score line and one of said two opposed edges.

7. The carton of claim 6, said weakened line of demarcation comprising a perforated line having at least one cut segment.

8. The carton of claim 5, further comprising a second score line extending substantially between said web structure and a proximate one of said two opposed edges.

9. The carton of claim 8, wherein said web structure includes a severance line extending between said tab and said point and wherein said second score line extends between said severance line and said proximate one of said two opposed edges.

* * * * *